US009074153B2

(12) United States Patent
Landschof et al.

(10) Patent No.: US 9,074,153 B2
(45) Date of Patent: Jul. 7, 2015

(54) UNLEADED FUEL COMPOSITIONS

(75) Inventors: Jörg Landschof, Hamburg (DE); Michael Clifford Macknay, Chester (GB); Timothy Michael Shea, The Woodlands, TX (US)

(73) Assignee: Shell Oil Company, Houston, TN (US)

( * ) Notice: Subject to any disclaimer, the term of this patent is extended or adjusted under 35 U.S.C. 154(b) by 0 days.

(21) Appl. No.: 13/553,505

(22) Filed: Jul. 19, 2012

(65) Prior Publication Data

US 2012/0279113 A1 Nov. 8, 2012

Related U.S. Application Data

(63) Continuation of application No. 11/609,742, filed on Dec. 12, 2006, now abandoned.

(51) Int. Cl.

| | |
|---|---|
| ***C10L 1/22*** | (2006.01) |
| ***C10L 1/18*** | (2006.01) |
| ***C10L 1/06*** | (2006.01) |
| ***C10L 1/02*** | (2006.01) |
| ***C10L 1/223*** | (2006.01) |
| ***C10L 10/10*** | (2006.01) |

(52) U.S. Cl.
CPC . *C10L 1/06* (2013.01); *C10L 1/023* (2013.01); *C10L 1/223* (2013.01); *C10L 10/10* (2013.01)

(58) Field of Classification Search
CPC ..... C10L 10/10; C10L 1/023; C10L 1/06; C10L 1/223
USPC ..... 44/426, 449
See application file for complete search history.

(56) References Cited

U.S. PATENT DOCUMENTS

| | | | | |
|---|---|---|---|---|
| 4,247,726 | A | 1/1981 | Slaugh | |
| 4,812,146 | A * | 3/1989 | Jessup | 44/449 |
| 5,015,356 | A | 5/1991 | Talbert | |
| 5,284,984 | A | 2/1994 | Dessau et al. | |
| 5,312,542 | A | 5/1994 | Talbert | |
| 5,470,358 | A * | 11/1995 | Gaughan | 44/426 |
| 6,030,521 | A | 2/2000 | Jessup et al. | |
| 6,353,143 | B1 | 3/2002 | Fang et al. | |
| 6,383,236 | B1 | 5/2002 | Welstand et al. | |
| 8,628,594 | B1 | 1/2014 | Braly | |
| 2002/0045785 | A1 * | 4/2002 | Bazzani et al. | 585/14 |
| 2002/0143216 | A1 | 10/2002 | Tsurutani et al. | |
| 2003/0046862 | A1 | 3/2003 | Wolf et al. | |
| 2003/0145514 | A1 | 8/2003 | Akimoto et al. | |
| 2003/0183554 | A1 | 10/2003 | Bazzani et al. | |
| 2004/0124122 | A1 | 7/2004 | Clark | |
| 2006/0102145 | A1 | 5/2006 | Cohn et al. | |
| 2006/0123696 | A1 | 6/2006 | Gaughn et al. | |
| 2008/0134571 | A1 | 6/2008 | Landschof et al. | |
| 2009/0277078 | A1 | 11/2009 | Schweiger et al. | |
| 2010/0018112 | A1 | 1/2010 | Russo et al. | |

FOREIGN PATENT DOCUMENTS

| | | |
|---|---|---|
| AU | 2006351908 B2 | 12/2006 |
| AU | 2006351908 | 6/2011 |
| CA | 2672211 | 6/2014 |
| EP | 1359207 | 11/2003 |
| EP | 1650287 | 4/2006 |
| EP | 1650289 | 4/2008 |
| EP | 2031043 | 7/2010 |
| GB | 2433265 | 6/2007 |
| WO | 0073403 | 12/2000 |
| WO | 0222766 | 3/2002 |

OTHER PUBLICATIONS

HSE (Health & Safety Executive) Occupational Medicine and Hygiene Laboratory, "Aromatic Amines in Air and on Surfaces," MDHS 75 (Methods for the Determination of Hazardous Substances), Feb. 1993, pp. 1-4.

J. Gary, et al., "Petroleum Refining," Technology and Economics (2d Ed. 1984) Chapter 10, pp. 159-183.

Kirk-Othmer., Concise Encyclopedia of Chemical Technology (4th Ed. 1999) vol. 1, pp. 75-76.

Tolga Topgül et al., "The effects of ethanol-unleaded gasoline blends and ignition timing on engine performance and exhaust emissions," Renewable Energy, vol. 31, (2006), pp. 2534-2542, XP025105627.

Anonymous, "Units with special names and symbols: units that incorporate special names and symbols," Internet Citation Oct. 16, 2007, XP007914325, Retrieved from the Internet: URL:http://web.archive.org/web/20071016181335/http://www.bipm.org/en/si/si_brochure/chapter2/2-2/2-2-2.html [retrieved on Aug. 6, 2010].

Werner Dabelstein et al., "Automotive Fuels," Internet Citation, Jan. 1, 2007, pp. 1-36, XP007910433.

Ghosh, P., et al., "Development of a Detailed Gasoline Composition-Based Octane Model," Ind. Eng. Chem. Res. 2006, vol. 45, pp. 337-345.

State Actions Banning MTBE (Statewide) EPA420-B-04-009, Jun. 2004.

* cited by examiner

*Primary Examiner* — James Goloboy
*Assistant Examiner* — Latosha Hines

(57) ABSTRACT

An unleaded fuel composition comprising: a combination of alkylated benzenes comprising alkyl groups having from 1 to 4 carbon atoms; 5 vol. % or more of one or more aromatic amines; and, an isoparaffin composition selected from the group consisting of alkylate, a combination of isoparaffins having a total number of carbon atoms of 11 or less, and combinations thereof.

72 Claims, No Drawings

UNLEADED FUEL COMPOSITIONS

The present application is a continuation of U.S. patent application Ser. No. 11/609,742, filed Dec. 12, 2006 (pending), which claims the benefit of PCT patent application No. PCT/US/2006/061825, filed Dec. 11, 2006, the entire disclosures of which are hereby incorporated by reference.

FIELD OF THE INVENTION

The present application relates to unleaded fuel compositions.

BACKGROUND OF THE INVENTION

In the operation of spark-induced combustion engines, and particularly automotive engines operating on gasoline, the octane rating of the fuel must be high enough to prevent knocking. Gasolines sold at service stations typically have an octane rating of from about 87 to about 93. Fuels having such octane ratings are satisfactory for most automotive engines.

For high performance engines, and for racing engines in particular, fuels of even higher octane ratings are required. The production of fuels of progressively higher octane values is progressively more difficult to achieve. In particular, fuels of octane value at or above 100 are highly desired and the most difficult to produce. This is particularly true for unleaded fuels.

A need exists for unleaded fuel compositions having high octane ratings.

SUMMARY OF THE INVENTION

The present application provides unleaded fuel compositions having an octane rating of 105 or more.

The present application provides unleaded fuel compositions having an octane rating greater than 105.

The present application provides unleaded fuel compositions having an octane rating of 106 or more.

The present application also provides unleaded fuel compositions having an octane rating of 110 or more.

The present application also provides an unleaded fuel composition comprising: a combination of alkylated benzenes comprising alkyl groups having from 1 to 4 carbon atoms; 5 vol. % or more of one or more aromatic amines; and, an isoparaffin composition selected from the group consisting of alkylate, a combination of isoparaffins having a total number of carbon atoms of 11 or less, and combinations thereof.

The present application also provides an unleaded fuel composition comprising: an isoparaffin composition comprising alkylate; a combination of alkylated benzenes comprising alkyl groups having from 1 to 4 carbon atoms; and, one or more aromatic amines comprising an aromatic ring comprising an amine substituent.

The present application also provides an unleaded fuel composition comprising: from about 40 vol. % to about 50 vol. % alkylate; from about 30 vol. % to about 40 vol. % toluene; from about 10 vol. % to about 20 vol. % m-xylene; and, from 2 vol. % to about 12 vol. % aniline.

The present application also provides an unleaded fuel composition comprising: about 44 vol. % alkylate comprising about 70 vol. % or more isoparaffins having a total of 8 carbon atoms; about 34 vol. % toluene; about 15 vol. % m-xylene; and, about 7 vol. % aniline.

DETAILED DESCRIPTION OF THE INVENTION

The present application provides unleaded fuel compositions having an octane rating which is higher than typically demonstrated by similar unleaded fuels. Without limiting the invention to a particular theory of operation, the unleaded fuels of the present application comprise aromatic amine, which is believed to contribute to a higher octane rating.

It is advantageous for the unleaded fuel compositions to have an octane rating sufficiently high to prevent knocking. In high performance applications, it is advantageous for unleaded fuel compositions to have an octane rating sufficiently high to boost power output from the high performance engine. In one embodiment, the application provides an unleaded racing fuel having an octane rating sufficiently high to boost the power output from a racing engine.

The octane rating of a fuel composition generally is calculated as the sum of the Research Octane Number (RON) and the Motor Octane Number (MON) divided by 2, i.e., (R+M)/2. Unless otherwise indicated, the Research Octane Number (RON) is determined according to method ASTM D-2699-04a (2004) and the Motor Octane Number (MON) is determined according to method ASTM D-2700-04a (2004), both incorporated by reference.

In one embodiment, the unleaded fuel composition of the present application has an octane rating of about 105 or more. In one embodiment, the unleaded fuel composition has an octane rating of greater than 105. In another embodiment, the unleaded fuel composition of the present application has an octane rating of about 106 or more. In one embodiment, the unleaded fuel composition has an octane rating of about 110 or more.

In one embodiment, the unleaded fuel composition comprises: a combination of alkylated benzenes; one or more aromatic amines; and, an isoparaffin composition selected from the group consisting of alkylate, a combination of isoparaffins having a total number of carbon atoms of 11 or less, and combinations thereof.

In one embodiment, the unleaded fuel composition comprises: an isoparaffin composition comprising alkylate; a combination of alkylated benzenes; and, one or more aromatic amine. This embodiment has the advantage of being relatively less costly due to the use of isoparaffin composition comprising alkylate.

The unleaded fuel composition optionally comprises one or more oxygenate octane booster. The unleaded fuel composition also optionally comprises one or more additional additives.

The Alkylated Benzenes

The unleaded fuel composition comprises a combination of alkylated benzenes.

In one embodiment, the unleaded fuel composition comprises about 20 vol. % or more of a combination of alkylated benzenes. Where used herein, the term "vol. %" is based on the total volume of the unleaded fuel composition, unless otherwise indicated. In one embodiment, the unleaded fuel composition comprises about 25 vol. % or more alkylated benzenes. In yet another embodiment, the unleaded fuel composition comprises about 40 vol. % or more alkylated benzenes.

In one embodiment, the unleaded fuel composition comprises about 60 vol. % or less alkylated benzenes. In one embodiment, the unleaded fuel composition comprises about 55 vol. % or less alkylated benzenes. In yet another embodiment, the unleaded fuel composition comprises about 50 vol. % or less alkylated benzenes.

Suitable alkylated benzenes have the following general structure:

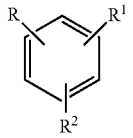

wherein R, $R^1$, and $R^2$ are selected from the group consisting of hydrogen and alkyl groups having from 1 to 4 carbon atoms, provided that at least one of R, $R^1$, and $R^2$ is an alkyl group. In one embodiment, R, $R^1$, and $R^2$ are selected from the group consisting of hydrogen and alkyl groups having from 1 to 2 carbon atoms. In one embodiment, R, $R^1$, and $R^2$ are selected from the group consisting of hydrogen and methyl groups. In one embodiment, the alkylated benzene is mono-alkylated benzene. In another embodiment, the alkylated benzene is a di-alkylated benzene. In another embodiment, the alkylated benzene is a tri-alkylated benzene. In one embodiment, one or more of R, $R^1$, and $R^2$ are methyl groups.

In an advantageous embodiment, the alkylated benzenes are a combination of mono-alkylated benzene, di-alkylated benzene, and tri-alkylated benzene. In one embodiment, the unleaded fuel composition comprises a combination of monomethyl benzene and dimethyl benzene. In one embodiment, the combination further comprises trimethyl benzene. In one embodiment, the unleaded fuel composition comprises a combination of xylene and toluene. In one embodiment, the unleaded fuel composition further comprises 1,3,5-trimethylbenzene.

The Aromatic Amine

The unleaded fuel composition also comprises one or more aromatic amine.

For lower performance applications, it is possible for the unleaded fuel composition to comprise about 0.1 vol. % or more of one or more aromatic amine. This is particularly true where the isoparaffin comprises the less expensive alkylate. In one embodiment, the unleaded fuel composition comprises about 0.5 vol. % or more of the aromatic amine. In one embodiment, the unleaded fuel composition comprises about 1 vol. % or more of the aromatic amine. In one embodiment, the unleaded fuel composition comprises about 2 vol. % or more of the aromatic amine.

In one embodiment, which is particularly advantageous for high performance applications, the unleaded fuel composition comprises 5 vol. % or more of the aromatic amine. In one embodiment, the unleaded fuel composition comprises greater 5 vol. % of the aromatic amine. In one embodiment, the unleaded fuel composition comprises about 6 vol. % or more of the aromatic amine. In another embodiment, the unleaded fuel composition comprises about 7 vol. % or more of the aromatic amine.

In one embodiment, the unleaded fuel composition comprises about 15 vol. % or less of the aromatic amine. In one embodiment, the unleaded fuel composition comprises from about 10 vol. % or less of the aromatic amine. In one embodiment, the unleaded fuel composition comprises 8 vol. % or less of the aromatic amine. In one embodiment, the unleaded fuel composition contains about 7 vol. % of the aromatic amine.

As used herein, the phrase "aromatic amine" refers to one or more aromatic amines having the following general structure:

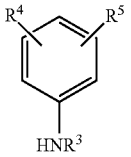

wherein R3, $R^4$ and $R^5$ independently are selected from the group consisting of hydrogen and alkyl groups having from about 1 to 4 carbon atoms. In one embodiment, $R^3$ is hydrogen. In one embodiment, the alkyl groups have from about 1 to 2 carbon atoms. In one embodiment, the alkyl groups are methyl groups. In one embodiment, $R^3$, $R^4$ and $R^5$ are hydrogens.

In one embodiment, the aromatic amine has one or more alkyl substituents on the aromatic ring. In this embodiment, the alkyl group may be at any position relative to the nitrogen containing substituent. In one embodiment, the alkyl group is at a meta-position relative to the nitrogen containing substituent. In one embodiment, the alkyl group is at a para-position relative to the nitrogen containing substituent.

In another embodiment, the nitrogen bears an alkyl group. However, where the nitrogen bears an alkyl group, the octane rating of the unleaded fuel may not be as high. Where the nitrogen bears an alkyl group, it may be desirable to include an oxygenate octane booster.

Aromatic amines used in the examples have the following general structure:

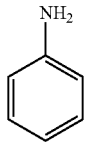

Aniline

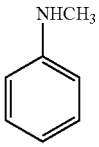

N-methyl aniline

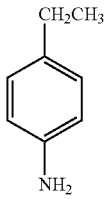

4-ethyl aniline

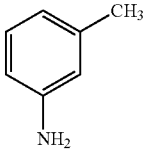

m-toluidine

The Isoparaffin Composition

The unleaded fuel composition also comprises an isoparaffin composition.

In one embodiment, the unleaded fuel composition comprises about 40 vol. % or more of the isoparaffin composition. In one embodiment, the unleaded fuel composition comprises about 45 vol. % or more of the isoparaffin composition. In one embodiment, the unleaded fuel composition comprises about 50 vol. % or more of the isoparaffin composition.

In one embodiment, the unleaded fuel composition comprises about 80 vol. % or less of the isoparaffin composition. In one embodiment, the unleaded fuel composition comprises from about 70 vol. % or less of the isoparaffin composition. In one embodiment, the unleaded fuel composition comprises about 60 vol. % or less of the isoparaffin composition.

Suitable isoparaffin compositions comprise alkylate, a combination of isoparaffins, and combinations thereof.

Alkylate

In one embodiment, the isoparaffin composition comprises alkylate. The term "alkylate" typically refers to branched-chain paraffin. The branched-chain paraffin typically is derived from the reaction of isoparaffin with olefin. Alkylation is described, for example, in J. Gary, et al. *Petroleum Refining, Technology and Economics* (2d Ed. 1984) Chapter 10, pp. 159-183, and in *Kirk Othmer. Concise Encyclopedia of Chemical Technology* ($4^{th}$ Ed. 1999) Vol. 1, p. 75-76. Both of the foregoing references are incorporated herein by reference.

Various grades of branched chain isoparaffins and mixtures are available. The grade is identified by the range of the number of carbon atoms per molecule, the average molecular weight of the molecules, and the boiling point range of the alkylate. As used herein, the word "alkylate" refers to hydrocarbon compositions used for fuel applications (a) having at least 55 normalized vol. % C5-C10 iso-paraffins measured pursuant to ASTM test method D-6730-01 (2001), or having at least 55 vol. % C5-C10 iso-paraffins measured pursuant to ASTM test method D-6733-01 (2001). The foregoing ASTM test methods are incorporated herein by reference.

In one embodiment, the alkylate is a refinery grade alkylate formed by the reaction of a C3-C5 stream with isobutene. In this embodiment, the alkylate advantageously comprises about 70 vol. % or more isoparaffins having a total of 8 carbon atoms. In one embodiment, the alkylate advantageously comprises greater than 70 vol. % isoparaffins having a total of 8 carbon atoms. In one embodiment, the alkylate advantageously comprises about 73 vol. % or more isoparaffins having a total of 8 carbon atoms. In one embodiment, the alkylate comprises about 90 vol. % or less isoparaffins having a total of 8 carbon atoms. In yet another embodiment, the alkylate comprises about 85 vol. % or less isoparaffins.

In one embodiment, the alkylate comprises less than 5 vol. % isoparaffins having a total of 6-7 carbon atoms.

Suitable alkylate typically has a RON of, for example, from about 90 to about 95. Suitable alkylate typically has a MON of, for example, from about 88 to about 95. Suitable alkylate typically has an octane rating of, for example, from about 90 to about 95.

Suitable alkylates can be obtained from a variety of sources, including Solvents & Chemicals, Pearland, Tex.; Equistar Chemicals; and, Texas Petrochemicals.

Combination of Isoparaffins

In one embodiment, the isoparaffin composition comprises a combination of isoparaffins. Suitable isoparaffins have the following general structure:

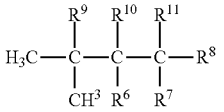

wherein $R^6$, $R^7$, $R^8$, $R^9$, $R^{10}$, and $R^{11}$ independently are selected from the group consisting of hydrogen and alkyl groups having from about 1 to about 7 carbon atoms, provided that the total number of carbon atoms is 11 or less. In one embodiment, $R^6$, $R^7$, $R^8$, $R^9$, $R^{10}$, and $R^{11}$ independently are selected from the group consisting of hydrogen and methyl groups. In an advantageous embodiment, the unleaded fuel comprises a combination of iso-pentane and iso-octane. In another advantageous embodiment, the unleaded fuel composition comprises primarily trimethyl pentane. In one embodiment, the unleaded fuel composition comprises primarily 2,2,4-trimethyl pentane.

The isoparaffins are commercially available from a variety of sources and/or may be made by known processes. Examples of suitable preparations are described in F. L. Howard, et al. *J. Res. Nat. Bur. Standards Research Paper RP*1779, Vol. 38 (March 1947) pp. 365-395, incorporated herein by reference. The isoparaffins made by the above processes may be used as a blend or purified further.

If desired, the isoparaffins may be obtained by fractional distillation of refinery streams, e.g., straight run gasolines, or alkylation products. Other known methods of making the isoparaffins include, for example, reaction of alkyl metallic compounds (Grignard reagents) with carbonyl compounds, such as aldehydes, ketones, esters, or anhydrides, to form branched chain carbinols, which are dehydrated to the corresponding olefin and thereafter hydrogenated to the alkane.

Oxygenate Octane Booster

The unleaded fuel composition optionally comprises oxygenate octane booster. The oxygenate octane booster may be any liquid organic molecule containing one or more alkyl group and one or more oxygen atom. Suitable oxygenate octane boosters include, for example, ethers and alcohols.

In one embodiment, the oxygenate octane booster is one or more alkyl ether. In one embodiment, the alkyl ether comprises an alkyl group having from 1 to 6 carbon atoms. In one embodiment, the alkyl group has from 3 to 6 carbon atoms. In one embodiment, the alkyl group is a branched chain alkyl group having from 3 to 6 carbon atoms. In an advantageous embodiment, the alkyl group is a tertiary alkyl group having from 4 to 6 carbon atoms. Suitable tertiary alkyl groups include, for example, tert-butyl groups and tert-amyl groups.

In one embodiment, the alkyl ether is dialkyl ether. In one embodiment, the alkyl ether is asymmetric dialkyl ether. In one embodiment, the dialkyl ether comprises a tertiary alkyl group and a second alkyl group having from 1 to 6 carbon atoms. In one embodiment, the dialkyl ether comprises a first tertiary alkyl group and second alkyl group having from 1 to 3 carbon atoms. In one embodiment, the second alkyl group is a linear alkyl group. In one embodiment, the second alkyl group is selected from the group consisting of a methyl group and an ethyl group. Specific examples of suitable alkyl ethers include methyl tertiary butyl ether (MTBE), ethyl tertiary butyl ether, and methyl tertiary amyl ether.

The use of an oxygenate octane booster in the unleaded fuel composition is optional. The unleaded fuel composition may comprise, for example, 25 vol. % or less oxygenate octane booster. In one embodiment, the unleaded fuel composition comprises about 20 vol. % or less oxygenate octane booster. In one embodiment, the unleaded fuel composition comprises about 16 vol. % or less oxygenate octane booster. In one embodiment, the unleaded fuel composition comprises about 8 vol. % or more oxygenate octane booster. In one embodiment, the unleaded fuel composition comprises about 10 vol. % or more oxygenate octane booster. In another embodiment, the unleaded fuel composition comprises about 12 vol. % or more oxygenate octane booster.

Suitable oxygenate octane boosters are made using known processes and are available commercially from a variety of sources.

Other Components

The unleaded fuel composition optionally may comprise a variety of other components as long as they are suitable for combustion in an automotive spark ignition engine and they do not have a significant impact on octane number. A component does not have a significant impact on octane number if, in the concentration(s) employed, the octane number is not raised or lowered by more than about 1.0 unit, as calculated by ASTM D-2699-04a (2004), incorporated herein by reference.

Suitable components include, for example, motor gasoline additives as listed in ASTM D-4814-04, incorporated herein by reference, or as specified by a regulatory body, e.g., U.S. California Air Resources Board (CARB) or the U.S. Environmental Protection Agency (EPA).

Examples of other components suitable for use in the unleaded fuel composition include other paraffins, aromatic hydrocarbons, alcohols, ethers, and/or esters. Refinery streams that may be used in the unleaded fuel include, for example, distillation products and reaction products from a refinery such as catalytic reformate, heavy catalytic cracked spirit, light catalytic cracked spirit, straight run gasoline, isomerate, light reformate, light hydrocrackate, and naphtha. Other gasoline components include olefins (in particular with one double bond per molecule). Examples include liquid alkene having from 5 to 10 carbon atoms. In one embodiment, the liquid alkene has from 6 to 8 carbon atoms. The liquid alkene may be linear or branched. Specific examples of suitable liquid alkenes include pentene, isopentene, hexene, isohexene, heptene, and mixtures thereof.

Examples of other paraffins that may be used in the unleaded fuel include, for example, straight-chain paraffins and cyclic paraffins. Straight chain paraffins are sometimes also referred to as normal paraffins.

The fuel also may contain lead replacement additives and/or other common additives which have no significant impact on octane value, for example, dyes, deicing agents, agents for preventing exhaust valve seat wear, anti-oxidants, corrosion inhibitors, anti-static additives, detergents and the like.

The unleaded fuel composition may not comprise any additive. The unleaded fuel composition also may comprise one or more additives. Where used, the unleaded fuel composition typically comprises about 1000 ppm or less total amount of additives. Where one or more additives are present, each additive typically is present in an amount of about 0.1 ppm or more. In one embodiment, each additive is present in an amount of about 0.5 ppm or more. In one embodiment, each additive is present in an amount of about 1 ppm or more. In one embodiment, each additive is present in an amount of 100 ppm or less. In one embodiment, each additive is present in an amount of 50 ppm or less. In one embodiment, each additive is present in an amount of 20 ppm or less.

In one embodiment, the unleaded fuel composition comprises lead replacement additive. In one embodiment, the unleaded fuel composition comprises antioxidant. In one embodiment, the unleaded fuel composition comprises detergent additive. In one embodiment, the unleaded fuel composition comprises a combination of lead replacement additive, antioxidant, and detergent additive.

Where used, the unleaded fuel composition typically comprises, for example, about 20 mg/kg or more lead replacement additive. In one embodiment, the unleaded fuel composition comprises from about 25 mg/kg or more lead replacement additive. In one embodiment, the unleaded fuel composition comprises about 30 mg/kg or more lead replacement additive. In one embodiment, the unleaded fuel composition comprises about 60 mg/kg or less lead replacement additive. In one embodiment, the unleaded fuel composition comprises about 55 mg/kg or less lead replacement additive. In one embodiment, the unleaded fuel composition comprises about 50 mg/kg or less lead replacement additive.

Where used, the unleaded fuel composition typically comprises, for example, about 10 mg/kg or more antioxidant. In one embodiment, the unleaded fuel composition comprises about 15 mg/kg or more antioxidant. In one embodiment, the unleaded fuel composition comprises about 20 mg/kg or more antioxidant. In one embodiment, the unleaded fuel composition comprises about 50 mg/kg or less antioxidant. In one embodiment, the unleaded fuel composition comprises about 45 mg/kg or less antioxidant. In one embodiment, the unleaded fuel composition comprises about 40 mg/kg or less antioxidant.

Where used, the unleaded fuel composition typically comprises, for example, about 0.05 g/gallon or more detergent additive. In one embodiment, the unleaded fuel composition comprises about 0.08 g/gallon or more detergent additive. In one embodiment, the unleaded fuel composition comprises about 0.1 g/gallon or more detergent additive. In one embodiment, the unleaded fuel composition comprises about 4 g/gallon or less detergent additive. In one embodiment, the unleaded fuel composition comprises about 3.5 g/gallon or less detergent additive. In one embodiment, the unleaded fuel composition comprises about 3 g/gallon or less detergent additive.

In a particularly advantageous embodiment, the unleaded fuel composition comprises: about 40 mg/kg lead replacement additive; about 30 mg/kg antioxidant; and, from about 1 to about 2 g/gallon detergent additive.

Suitable additives are made using known processes and are available commercially from a variety of sources.

Specific Formulations

In one embodiment, the unleaded fuel composition comprises: a combination of alkylated benzenes; greater than 5 vol. % of one or more aromatic amines; and, an isoparaffin composition selected from the group consisting of alkylate, a combination of isoparaffins having a total number of carbon atoms of 11 or less, and combinations thereof.

In one embodiment, the unleaded fuel composition comprises: from about 20 vol. % to about 60 vol. % of the combination of alkylated benzenes; from greater than 5 vol. % to about 15 vol. % of the one or more aromatic amine; and, from about 40 vol. % to about 80 vol. % of the isoparaffin composition. In one embodiment, the unleaded fuel composition comprises greater than 5 vol. % of the aromatic amine. In one embodiment, the unleaded fuel composition comprises about 7 vol. % or more of the aromatic amine. In one embodiment, the unleaded fuel composition comprises about 10 vol. % or less of the aromatic amine. In one embodiment, the unleaded fuel composition comprises about 7 vol. % or less of the aromatic amine. In one embodiment, the unleaded fuel composition contains about 7 vol. % of the aromatic amine. In one embodiment, the unleaded fuel composition further comprises one or more oxygenate octane booster.

In one embodiment, the unleaded fuel composition comprises: alkylate; a combination of alkylated benzenes; and, one or more aromatic amines. In an advantageous embodiment, the unleaded fuel composition comprises: from about 40 vol. % to about 50 vol. % alkylate; from about 30 vol. % to about 40 vol. % toluene; from about 10 vol. % to about 20 vol. % m-xylene; and, from about 2 vol. % to about 12 vol. % aniline. In one embodiment, the unleaded fuel composition comprises about 5 vol % or more aniline.

In one embodiment, the unleaded fuel composition comprises additional additives. In one embodiment, the unleaded fuel composition a combination of lead replacement additive, antioxidant, and detergent additive. The unleaded fuel composition also optionally may comprise one or more oxygenate octane booster.

Specific examples of suitable blends are given in the following examples, which are illustrative only and should not be construed as limiting the claims:

COMPARATIVE EXAMPLE 1

U.S. Pat. No. 4,812,146 to Jessup relates to fuels for high performance engines and for racing engines in particular. Jessup describes fuel compositions having octane ratings of "at least about 100 . . . comprised of toluene and alkylate and at least two further components selected from the group consisting of [isopentane], n-butane and methyl tertiary butyl ether." Jessup, abstract. Jessup Tables 4 and 7 show ingredients and concentration ranges which meet minimum octane rating requirements of about 100. The highest "Actual Octane Value" that Jessup appears to achieve using the blends is 101. Table 8, Blend #9.

COMPARATIVE EXAMPLE 2

U.S. Patent Application 2003/0183554 to R. Bazzani, et al. ("Bazzani") describes unleaded blend compositions, as well as formulated gasolines containing them, having a Motor Octane Number (MON) of at least 80 comprising a variety of isoparaffin compositions. The composition may comprise at least one aromatic compound, for example having 6-9 carbons, preferably an alkyl aromatic compound such as toluene or o, m, or p xylene or a mixture thereof or a trimethyl benzene. Aromatic amines may be used "in an amount of less than 5% by volume for mogas or avgas, and are preferably substantially absent . . . e.g., less than 100 ppm." Bazzani, paragraph [0051].

Bazzani states with respect to the compositions of Bazzani's "part (a)" that the ROAD value (or octane rating) "is usually 85-115 e.g. 98-115 or preferably 85-98 such as 85-95 e.g. 85-90, or 90-95 or 95-98. Preferred gasoline compositions have . . . ROAD 85-90 . . . ROAD 85-95 or . . . ROAD 90-95." Bazzani paragraph [0056]. While Bazzani states that the compositions of "part (a)" can reach a ROAD value over 105, Bazzani does not state that the compositions tested in the relevant Examples either (a) contained 5 vol. % or more aromatic amine, or (b) had a ROAD value of greater than 105. The highest ROAD value actually reported in the Examples relevant to "part (a)" is 97.25 (Table 1, p. 12).

Bazzani states with respect to the compositions in "part (b)" that "the ROAD value is usually 85-107 e.g. 98-106 or preferably 85-98 such as 85-95 e.g. 85-90, or 90-95 or 95-98. Preferred gasoline compositions have . . . ROAD 85-90, or . . . ROAD 85-95 or . . . ROAD 91-96." Bazzani, paragraph [0238]. Although Bazzani states that the compositions of "part (b)" can reach a ROAD value over 105, Bazzani does not state that the compositions tested in the relevant Examples either (a) contained 5 vol. % or more aromatic amine, or (b) had a ROAD value of greater than 105. In fact, the RON and MON values reported in the Examples relevant to part (b) are below 100, and therefore the ROAD value is below 100. Bazzani, pp. 31-34.

Bazzani states with respect to the compositions in "part (c)" that "the ROAD value is usually 85-110 or 85-107 e.g. 98-106 or 102-108 or 85-95. Preferred gasoline compositions have . . . ROAD 89-96 but especially ROAD 98-106." Bazzani, paragraph [0342] A ROAD value of 105 is reported for two of the compositions in the Examples relevant to part (c)(Table 23); however, Bazzani does not state that the compositions tested in the relevant Examples either: (a) contained 5 vol. % or more aromatic amine; (b) had a ROAD value of greater than 105; and/or, (c) comprised isoparaffin composition comprising alkylate. The compounds for which an octane rating of 105 is reported in Bazzani were made using the relatively expensive isoparaffin composition comprising a combination of "cpd A2" (2,2,3,3-tetramethylbutane) and "cpd Al" (2,2,3,3-tetramethylpentane). Bazzani Table 23 and paragraph [0317].

EXPERIMENTAL EXAMPLES

Synergies sometimes exist between compounds in fuel compositions which give results for certain properties that would be unexpected from traditional or theoretical methods of estimating that property. A large number of fuel compositions were tested to identify fuel compositions which have synergistic effects so as to yield unleaded fuel compositions having octane ratings of about 105 or more. Five unleaded fuel compositions (Blends 1-5) exhibited synergistic effects resulting in octane ratings of about 110 or more.

The blends tested had the following fuel components: Iso-octane=2,2,4-trimethylpentane; Iso-pentane=2-methylbutane; EtBE=Ethyl t-butyl ether (t=tertiary); toluene; m-xylene=3-methyltoluene or 1,3-dimethylbenzene; Aromatic amine=Aniline, N-methylaniline, 4-ethylaniline, and m-toluidine (3-methylaniline). In several of the tested blends, including Blend 5, the relatively expensive iso-octane and isopentane were replaced with relatively inexpensive alkylate. This embodiment has the advantage of rendering the unleaded fuel composition list costly to produce.

Example 1

A first blend had the following general formula:

BLEND 1

| Component | Vol. % |
|---|---|
| Iso-octane | 45-50% |
| Toluene | 14-18% |
| m-Xylene | 12-16% |
| Iso-pentane | 3-7% |
| 1,3,5-trimethylbenzene | 12-16% |
| Aromatic Amine | 5-10% |

The following formula within "Blend 1" was prepared and the octane number was determined:

| Component | Vol. % |
|---|---|
| Iso-octane | 45.5% |
| Toluene | 15% |
| m-Xylene | 14% |

-continued

| Component | Vol. % |
|---|---|
| Iso-pentane | 4.5% |
| 1,3,5-trimethylbenzene | 14% |
| Aniline | 7% |

In all of the examples, the RON, MON, and octane rating [R+M)/2] were measured according to ASTM D-2699-04a (RON) and ASTM D-2700-04a (MON)(2004). For the foregoing blend, the RON was 115.67, the MON was 106.0, and the octane number was 110.8.

Example 2

The following formula within "Blend 1" was prepared and the octane number was determined:

| Component | Vol. % |
|---|---|
| Iso-octane | 45.5% |
| Toluene | 15% |
| m-Xylene | 14% |
| Iso-pentane | 4.5% |
| 1,3,5-trimethylbenzene | 14% |
| m-toluidine | 7% |

The RON was 116.67, the MON was 106.33, and the octane number was 111.5. The foregoing results demonstrate that the formulas of Example 1 and Example 2 are effective to produce an octane number of 110 or more.

Example 3

The following formula within "Blend 1" was prepared and the octane number was determined:

| Component | Vol. % |
|---|---|
| Iso-octane | 45.5% |
| Toluene | 15% |
| m-Xylene | 14% |
| Iso-pentane | 4.5% |
| 1,3,5-trimethylbenzene | 14% |
| N-methylaniline | 7% |

The RON was 115.0, the MON was 97.5, and the octane number was 106.25. This example illustrates that N-methyl aniline did not produce an octane number of 110 or more, but did produce an octane number of 106 or more. Addition of an oxygenate booster, such as alkyl ether, is expected to increase the octane number.

BLEND 2

A second blend had the following general formula.

| Component | Vol. % |
|---|---|
| Iso-octane | 45-50% |
| Toluene | 21-26% |
| m-Xylene | 19-24% |
| Iso-pentane | 3-7% |
| Aromatic Amine | 5-10% |

Examples 4, 5 and 6 fall within "Blend 2."

Example 4

The following formula within "Blend 2" was prepared and the octane number was determined:

| Component | Vol. % |
|---|---|
| Iso-octane | 45.5% |
| Toluene | 23% |
| m-Xylene | 21% |
| Iso-pentane | 3.5% |
| Aniline | 7% |

The RON was 116.33, the MON was 105.33, and the octane number was 110.8.

Example 5

The following formula within "Blend 2" was prepared and the octane number was determined:

| Component | Vol. % |
|---|---|
| Iso-octane | 45.5% |
| Toluene | 23% |
| m-Xylene | 21% |
| Iso-pentane | 3.5% |
| m-toluidine | 7% |

The RON was 116.00, the MON was 105, and the octane number was 110.5.

Example 6

The following formula within "Blend 2" was prepared and the octane number was determined:

| Component | Vol. % |
|---|---|
| Iso-octane | 45.5% |
| Toluene | 23% |
| m-Xylene | 21% |
| Iso-pentane | 3.5% |
| N-methylaniline | 7% |

The RON was 115.0, the MON was 96.93, and the octane number was 106.0. This example illustrates that the use of N-methylaniline as the aromatic amine did not produce an octane number of 110 or more, but did produce an octane number of 106. Once again, the use of an oxygenate octane booster, such as alkyl ether, is expected to increase the octane number.

Example 7

A third blend had the following general formula.

BLEND 3

| Component | Vol. % |
|---|---|
| Iso-octane | 40-49% |
| Toluene | 13-17% |
| m-Xylene | 12-16% |
| Iso-pentane | 3-10% |

-continued

| Component | Vol. % |
|---|---|
| EtBE | 12-16% |
| Aromatic Amine | 5-10% |

The following formula within "Blend 3" was prepared and the octane number was determined:

| Component | Vol. % |
|---|---|
| Iso-octane | 40.5% |
| Toluene | 15% |
| m-Xylene | 14% |
| Iso-pentane | 9.5% |
| EtBE | 14% |
| Aniline | 7% |

The RON was 117.67, the MON was 104.67, and the octane number was 111.67.

Example 8

A fourth blend had the following general formula.

BLEND 4

| Component | Vol. % |
|---|---|
| Toluene | 13-17% |
| m-Xylene | 12-16% |
| Alkylate | 47-56% |
| EtBE | 12-16% |
| Aromatic Amine | 5-10% |

The following formula within "Blend 4" was prepared and the octane number was determined.

| Component | Vol. % |
|---|---|
| Toluene | 15% |
| m-Xylene | 14% |
| Alkylate | 50.0% |
| EtBE | 14% |
| Aniline | 7% |

The alkylate had the composition given in the following Table. The numbers in the Table represent the normalized volume %, based on the total volume of the composition, pursuant to ASTM test method D 6730-01, "Standard Test Method for Determination of Individual Components in Spark Ignition Engine Fuels by 100-Meter Capillary (with Precolumn) High-Resolution Gas Chromatography," incorporated herein by reference:

| Number of carbon atoms | Naphthene | Iso-paraffins | Normal paraffins | Aromatics |
|---|---|---|---|---|
| 4 | | | 0.36 | |
| 5 | | 4.07 | | |
| 6 | | 3.79 | | |
| 7 | | 3.93 | | 0.07 |
| 8 | 27.41 | 54.17 | | |
| 9 | | 1.73 | | |
| 10 | | 0.53 | | |
| 11 | 0.70 | | | |
| boiling point > 200° C. | | 3.24 | | |

The RON was 118.5, the MON was 101.9, and the octane number was 110.2.

Example 9

A fifth blend had the following general formula.

BLEND 5

| Component | Vol. % |
|---|---|
| Toluene | 30-40% |
| m-Xylene | 10-20% |
| Alkylate | 40-50% |
| Aromatic Amine | 2-12% |

The following formula within "Blend 5" was prepared and the octane number was determined.

| Component | Vol. % |
|---|---|
| Toluene | 34% |
| m-Xylene | 15% |
| Alkylate | 44% |
| Aniline | 7% |

The alkylate had the composition given in the following Table. The numbers in the Table represent volume %, based on the total volume of the composition, pursuant to ASTM test method D 6733-01, "Standard Test Method for Determination of Individual Components in Spark Ignition Engine Fuels by 50-Meter Capillary High-Resolution Gas Chromatography," incorporated herein by reference:

| Number of carbon atoms | Naphthene | iso-paraffins | normal paraffins | aromatics |
|---|---|---|---|---|
| 4 | | 1.01 | 3.75 | |
| 5 | | 10.47 | 0.18 | |
| 6 | 0.01 | 1.27 | 0.02 | |
| 7 | | 1.96 | | |
| 8 | 0.10 | 73.50 | | |
| 9 | 0.30 | 1.80 | | |
| 10 | 2.41 | 0.02 | | |
| 11 | | 2.79 | | |

The RON was 114, the MON was 105, and the octane number was 110.

Persons of ordinary skill in the art will recognize that many modifications may be made to the foregoing description. The embodiments described herein are meant to be illustrative only and should not be taken as limiting the invention, which will be defined in the claims.

What is claimed is:

1. An unleaded fuel composition comprising a blend comprising:

from about 40 vol. % to about 50 vol. % alkylate having an octane rating [(RON +MON)/2] of 90 or greater, the alkylate comprising less than 5 vol. % isoparaffins having a total of 6-7 carbon atoms and about 70 vol. % or more isoparaffins having a total of 8 carbon atoms;

a quantity, of from 7 vol. % to about 10 vol. % aromatic amine having the following general structure:

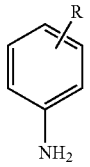

wherein R is selected from the group consisting of hydrogen and alkyl groups having from about 1 to 2 carbon atoms;

from about 49 vol. % to about 60 vol. % of a combination of alkylated benzenes comprising a quantity of about 30 vol. % or more toluene and a quantity of xylene, the quantity of xylene being up to about 20 vol. %;

wherein the alkylated benzenes and the quantity of aromatic amine produce the blend exhibiting a MON of 105 or more, the unleaded fuel composition being adapted to operate a high performance engine.

2. The unleaded fuel composition of claim 1 comprising one or more octane booster.

3. The unleaded fuel composition of claim 1 wherein R is selected from the group consisting of hydrogen and a methyl group.

4. The unleaded fuel composition of claim 3, the blend exhibiting an octane rating of 110 or more.

5. The unleaded fuel composition of claim 1 wherein the aromatic amine is aniline.

6. The unleaded fuel composition of claim 5 wherein the quantity of xylene is effective to produce the blend comprising 15 vol. % or more xylene.

7. The unleaded fuel composition of claim 6 wherein the quantity of toluene is effective to produce the blend comprising about 34 vol. % or more toluene.

8. The unleaded fuel composition of claim 1 wherein the quantity of xylene is effective to produce the blend comprising 15 vol. % or more xylene.

9. The unleaded fuel composition of claim 8 wherein the quantity of toluene is effective to produce the blend comprising about 34 vol. % or more toluene.

10. The unleaded fuel composition of claim 8 wherein R is selected from the group consisting of hydrogen and a methyl group.

11. The unleaded fuel composition of claim 9 wherein R is selected from the group consisting of hydrogen and a methyl group.

12. The unleaded fuel composition of claim 1 wherein the quantity of toluene is effective to produce the blend comprising about 34 vol. % or more toluene.

13. The unleaded fuel composition of claim 1 further comprising:

40 mg/kg lead replacement additive;

30 mg/kg antioxidant; and, from about 1 to about 2 g/gallon detergent additive.

14. The unleaded fuel composition of claim 1 further comprising 40 mg/kg lead replacement additive.

15. An unleaded fuel composition comprising a blend comprising:

an isoparaffin composition comprising a sufficient amount of iso-octane to produce the blend comprising from about 40 vol. % to about 50 vol. % iso-octane;

a quantity of from 7 vol. % to about 10 vol. % aromatic amine having the following general structure:

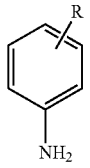

wherein R is selected from the group consisting of hydrogen and alkyl groups having from about 1 to 2 carbon atoms; and, from about 43 vol. % to about 60 vol. % of a combination of alkylated benzenes, wherein the selected alkylated benzenes, their respective amounts, and the quantity of aromatic amine produce the blend exhibiting a MON of 105 or more, the alkylated benzenes comprising toluene and one or more of (a) a quantity of xylene, the quantity of xylene being up to 20 vol. %, and (b), an amount of trimethylbenzene effective to produce the MON of 105 or more;

wherein the unleaded fuel composition is adapted to operate a high performance engine.

16. The unleaded fuel composition of claim 15 comprising one or more octane booster.

17. The unleaded fuel composition of claim 15 wherein R is selected from the group consisting of hydrogen and a methyl group.

18. The unleaded fuel composition of claim 17 wherein the blend exhibits an octane rating of 110 or more.

19. The unleaded fuel composition of claim 15 wherein the quantity of xylene is effective to produce the blend comprising 14 vol. % or more xylene.

20. The unleaded fuel composition of claim 19 wherein the amount of trimethylbenzene is from about 12 to about 16 vol. %.

21. The unleaded fuel composition of claim 15 wherein the blend comprises from about 3 to about 7 vol. % isopentane.

22. The unleaded fuel composition of claim 21 wherein the amount of trimethylbenzene is from about 12 to about 16 vol. %.

23. The unleaded fuel composition of claim 15 wherein the blend comprises 45 vol. % or more iso-octane.

24. The unleaded fuel composition of claim 15 wherein said amount of trimethvlbenzene is from about 12 to about 16 vol. %.

25. An unleaded fuel composition comprising a blend comprising:

a quantity of alkylate comprising isoparaffins and having an octane rating [(RON +MON)/2] of 90 or greater, the alkylate comprising less than 5 vol. % isoparaffins having a total of 6-7 carbon atoms and about 70 vol. % or more isoparaffins having a total of 8 carbon atoms;

an isoparaffin composition comprising an amount of iso-octane effective to produce the blend comprising 40 vol. % or more iso-octane;

a quantity of from 7 vol. % to about 10 vol. % aromatic amine having the following general structure:

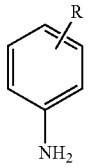

wherein R is selected from the group consisting of hydrogen and alkyl groups having from about 1 to 2 carbon atoms; from about 43 vol. % to about 60 vol. % of a combination of alkylated benzenes, wherein the selected alkylated benzenes, their respective amounts, and the quantity of aromatic amine produce the blend exhibiting a MON of 105 or more, the alklated benzenes comprising a quantity of about 40 vol. % or less toluene and one or both of (a) quantity of about 10 vol. % or more xylene, and(b) an amount trimethylbenzene sufficient to produce the MON of 105 or more;

wherein the unleaded fuel composition is adapted to operate a high performance engine.

26. The unleaded fuel composition of claim 25 comprising one or more octane booster.

27. The unleaded fuel composition of claim 26 wherein R is selected from the group consisting of hydrogen and a methyl group.

28. The unleaded fuel composition of claim 27 wherein the quantity of toluene is effective to produce the blend comprising 15 vol. % or more toluene.

29. The unleaded fuel composition of claim 25 wherein R is selected from the group consisting of hydrogen and a methyl group.

30. The unleaded fuel composition of claim 29 wherein the quantity of xylene is effective to produce the blend comprising 14 vol. % or more xylene.

31. The unleaded fuel composition of claim 30 wherein the quantity of toluene is effective to produce the blend comprising 15 vol. % or more toluene.

32. The unleaded fuel composition of claim 31 further comprising:

40 mg/kg lead replacement additive;

30 mg/kg antioxidant; and, from about 1 to about 2 g/gallon detergent additive.

33. The unleaded fuel composition of claim 25 further comprising:

40 mg/kg lead replacement additive;

30 mg/kg antioxidant; and, from about 1 to about 2 g/gallon detergent additive.

34. An unleaded fuel composition comprising a blend comprising:

an isoparaffin composition comprising iso-octane and isopentane in respective amounts effective to produce the blend comprising 45 vol. % or more iso-octane;

a quantity of from 7 vol. % to about 10 vol. % aromatic amine having the following general structure:

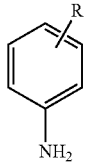

wherein R is selected from the group consisting of hydrogen and alkyl groups having from about 1 to 2 carbon atoms;

combination of about 60 vol. % or less alkylated benzenes comprising a quality of about 21 vol. % or more toluene and a quantity of xylene effective to produce a MON of 105 or more, the quantity of xylene being up to about 24 vol. %, wherein the combination of alkylated benzenes and the quantity of aromatic amine produce the blend exhibiting a MON of 105 or more; and the unleaded fuel composition is adapted to operate a high performance engine.

35. The unleaded fuel composition of claim 34 comprising one or more octane booster.

36. The unleaded fuel composition of claim 34 wherein R is selected from the group consisting of hydrogen and a methyl group.

37. The unleaded fuel composition of claim 36 wherein the blend comprises from about 3 to about 7 vol. % isopentane.

38. The unleaded fuel composition of claim 37 wherein the blend comprises 45 vol. % or more iso-octane.

39. The unleaded fuel composition of claim 36 wherein the blend comprises 45.5 vol. % or more iso-octane.

40. The unleaded fuel composition of claim 37 wherein the blend comprises 45.5 vol. % or more iso-octane.

41. The unleaded fuel composition of claim 38 further comprising:

40 mg/kg lead replacement additive;

30 mg/kg antioxidant; and, from about 1 to about 2 g/gallon detergent additive.

42. The unleaded fuel composition of claim 34 wherein the blend exhibits an octane rating of 110 or more.

43. The unleaded fuel composition of claim 34 wherein the blend comprises from about 3 to about 7 vol. % isopentane.

44. The unleaded fuel composition of claim 34 wherein the blend comprises 45 vol. % or more iso-octane.

45. The unleaded fuel composition of claim 34 wherein the blend comprises 45.5 vol. % or more iso-octane.

46. The unleaded fuel composition of claim 34 further comprising:

40 mg/kg lead replacement additive;

30 mg/kg antioxidant; and, from about 1 to about 2 g/gallon detergent additive.

47. An unleaded fuel composition comprising a blend comprising:

about 40 vol. % or more of one or more isoparaffin composition comprising a quantity of alkylate comprising isoparaffins and having an octane rating [(RON +MON)/2] of 90 or greater, the alkylate comprising less than 5 vol. % isoparaffins having a total of 6-7 carbon atoms and about 70 vol. % or more isoparaffins having a total of 8 carbon atoms;

a quantity of from 7 vol. % to about 10 vol. % aromatic amine having the following general structure:

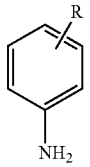

wherein. R is selected from the group consisting of hydrogen and alkyl groups having from about 1 to 2 carbon atoms;

an amount of a combination of alkylated benzenes, wherein the selected alkylated benzenes and their respective amounts combined with the quantity of aromatic amine produce the blend exhibiting a MON of 105 or more, the alkylated benzenes comprising (a) an amount of from about 43 vol. % to about 60 vol. % toluene and one or more of (i) quantity of xylene, the quantity of xylene being up to 20 vol. % and (ii), an amount of trimethylbenzene sufficient to produce the MON of 105 or more, and (b) from about 49 vol. % to about 60 vol. % of (i) an amount of toluene and (ii) a quantity of xylene, the quantity of xylene being up to 20 vol. %;

wherein the unleaded fuel composition is adapted to operate a high performance engine.

48. The unleaded fuel composition of claim 47 comprising one or more octane booster.

49. The unleaded fuel composition of claim 48 wherein R is selected from the group consisting of hydrogen and a methyl group.

50. The unleaded fuel composition of claim 49 further comprising:

40 mg/kg lead replacement additive;

30 mg/kg antioxidant; and, from about 1 to about 2 g/gallon detergent additive.

51. The unleaded fuel composition of claim 47 wherein R is selected from the group consisting of hydrogen and a methyl group.

52. The unleaded fuel composition of claim 47 further comprising:

40 mg/kg lead replacement additive;

30 mg/kg antioxidant; and, from about 1 to about 2 g/gallon detergent additive.

53. The unleaded fuel composition of claim 47 further comprising 40 mg/kg lead replacement additive.

54. An unleaded fuel composition comprising a blend comprising:

an isoparaffin composition consisting essentially of iso-octane and isopentane, the isoparaffin composition comprising a sufficient amount of iso-octane to produce the blend comprising 40 vol. % or more iso-octane;

a quantity of from 7 vol. % to about 10 vol. % aromatic amine having the following general structure:

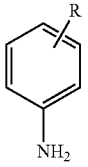

wherein R is selected from the group consisting of hydrogen and alkyl groups having from about 1 to 2 carbon atoms;

from about 43 vol. % to about 60 vol. % of a combination of alkylated benzenes, wherein the selected alkylated benzenes, their respective amounts, and the quantity of aromatic amine produce the blend exhibiting a MON of 105 or more, the alkylated benzenes comprising a quantity of toluene and one or more of (a) a quantity of xylene and (b) an amount of trimethylbenzene sufficient to produce the MON of 105 or more wherein the unleaded fuel composition is adapted to operate a high performance engine.

55. The unleaded fuel composition of claim 54 comprising one or more octane booster.

56. The unleaded fuel composition of claim 55 wherein R is selected from the group consisting of hydrogen and a methyl group.

57. The unleaded fuel composition of claim 56 further comprising:

40 mg/kg lead replacement additive;

30 mg/kg antioxidant; and, from about 1 to about 2 g/gallon detergent additive.

58. The unleaded fuel composition of claim 54 wherein R is selected from the group consisting of hydrogen and a methyl group.

59. The unleaded fuel composition of claim 54 further comprising:

40 mg/kg lead replacement additive;

30 mg/kg antioxidant; and, from about 1 to about 2 g/gallon detergent additive.

60. The unleaded fuel composition of claim 54 further comprising 40 mg/kg lead replacement additive.

61. An unleaded fuel composition comprising a base blend consisting of:

about 40 to 50 vol. % isoparaffin composition comprising alkylate having an octane rating [(RON +MON)/2] of 90 or greater, the alkylate comprising less than 5 vol. % isoparaffins having a total of 6-7 carbon atoms and about 70 vol. % or more isoparaffins having a total of 8 carbon atoms;

from about 43 vol. % to about 60 vol. % of a combination of one or more alkylated benzenes, wherein the selected alkylated benzenes, their respective amounts, and the quantity of aromatic amine produce the base blend exhibiting a MON of 105 or more, the alkylated benzenes comprising a quantity of 30 vol. % or more toluene a quantity of xylene, the quantity of xylene being up to about 20 vol. %, and, an amount of trimethylbenzene sufficient to produce the MON of 105 or more; and, from 7 vol. % to about 10 vol. % aromatic amine having the following general structure:

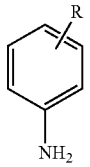

wherein R is selected from the group consisting of hydrogen and alkyl groups having from about 1 to 2 carbon atoms.

62. The unleaded fuel composition of claim 61 further consisting of:

40 mg/kg lead replacement additive;

30 mg/kg antioxidant;

from about 1 to about 2 g/gallon detergent additive; and, optionally, one or more octane booster.

63. An unleaded fuel composition comprising a base blend consisting of:

an isoparaffin composition comprising a sufficient amount of iso-octane to produce the base blend comprising 40 vol. % or more iso-octane;

from about 43 vol. % to about 60 vol. % of a combination of alkylated benzenes, wherein the selected alkylated benzenes, their respective amounts, and the quantity of aromatic amine produce the base blend exhibiting a MON of 105 or more the alkvlated benzenes comprising a quantity of toluene, a quantity of xylene, the quantity of xylene being up to 20 vol. %, and, optionally, an amount of trimethylbenzene sufficient to produce the MON of 105 or more; and, from 7 vol. % to about 10 vol. % aromatic amine having the following general structure:

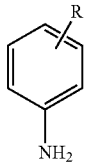

wherein R is selected from the group consisting of hydrogen and alkyl groups having from about 1 to 2 carbon atoms.

64. The unleaded fuel composition of claim 63 further consisting of:

40 mg/kg lead replacement additive;

30 mg/kg antioxidant;

from about 1 to about 2 g/gallon detergent additive; and, optionally, one or more octane booster.

65. An unleaded fuel composition comprising a base blend consisting of:

a quantity of alkylate comprising isoparaffins and having an octane rating [(RON +MON)/2] of 90 or greater, the alkylate comprising less than 5 vol. % isoparaffins having a total of 6-7 carbon atoms and about 70 vol. % or more isoparaffins having a total of 8 carbon atoms;

an isoparaffin composition comprising an amount of iso-octane effective to produce the blend comprising 40 vol. % or more iso-octane;

from about 43 vol. % to about 60 vol. % of a combination of alkylated benzenes, wherein the selected alkylated benzenes, their respective amounts, and the quantity of aromatic amine produce the blend exhibiting a MON of 105 or more, the alkylated benzenes comprising a quantity of toluene, a quantity of xylene, the quantity of xylene being up to 20 vol. %, and a quantity of trimethylbenzene sufficient to produce the MON 105 or more; and, from 7 vol. % to about 10 vol. % aromatic amine having the following general structure:

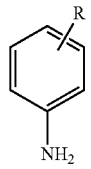

wherein R is selected from the group consisting of hydrogen and alkyl groups having from about 1 to 2 carbon atoms.

66. The unleaded fuel composition of claim 65 further consisting of:

40 mg/kg lead replacement additive;

30 mg/kg antioxidant;

from about 1 to about 2 g/gallon detergent additive; and, optionally, one or more octane booster.

67. An unleaded fuel composition comprising a base blend consisting of:

an isoparaffin composition comprising iso-octane and isopentane in respective amounts effective to produce the blend comprising 45 vol. % or more iso-octane;

a combination of about 60 vol. % or less alkylated benzenes comprising about 21 vol. % or more toluene and a quantity of xylene, the quantity of xylene being up to about 24 vol. %; and, from 7 vol. % to about 10 vol. % aromatic amine having the following general structure:

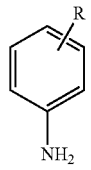

wherein R is selected from the group consisting of hydrogen and alkyl groups having from about 1 to 2 carbon atoms;

the base blend exhibiting a MON of 105 or more.

68. The unleaded fuel composition of claim 67 further consisting of:

40 mg/kg lead replacement additive;

30 mg/kg antioxidant;

from about 1 to about 2 g/gallon detergent additive; and, optionally, one or more octane booster.

69. An unleaded fuel composition comprising a base blend consisting of:

one or more isoparaffin composition comprising a quantity of alkylate comprising isoparaffins and having an octane rating [(RON +MON)/2 ] of 90 or greater, the alkylate comprising less than 5 vol. % isoparaffins having a total of 6-7 carbon atoms and about 70 vol. % or more iso-paraffins having a total of 8 carbon atoms;

a combination of alkylated benzenes, wherein the selected alkylated benzenes, their respective amounts, and the quantity of aromatic amine produce the blend exhibition a MON of 105 or more, the alklated benzenes being selected from the group consisting of (a) from about 43 vol. % to about 60 vol. % of a combination of a quantity of toluene, a quantity of xylene, and quantity of trimethylbenzene effective to produce the MON of 105 or more, and (b) from about 49 vol. % to about 60 vol. % of a quantity of toluene and a quantity of xylene effective to produce the MON of 105 or more; and, from 7 vol. % to about 10 vol. % aromatic amine having the following general structure:

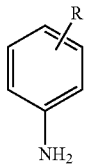

wherein R is selected from the group consisting of hydrogen and alkyl groups having from about 1 to 2 carbon atoms.

70. The unleaded fuel composition of claim 69 further consisting of:

40 mg/kg lead replacement additive;

30 mg/kg antioxidant;

from about 1 to about 2 g/gallon detergent additive; and, optionally, one or more octane booster.

71. An unleaded fuel composition comprising a base blend consisting of:

an isoparaffin composition consisting essentially of iso-octane and isopentane, the isoparaffin composition comprising a sufficient amount of iso-octane to produce the base blend comprising 40 vol. % or more iso-octane;

from about 43 vol. % to about 60 vol. % of a combination of alkylated benzenes, wherein the selected alkvlated benzenes, their respective amounts, and the quantity of aromatic amine produce the blend exhibiting a MON of 105 or more, the alkylated benzenes being selected from the group consisting toluene, xylene, and trimethylbenzene; and, from 7 vol. % to about 10 vol. % aromatic amine having the following general structure:

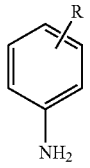

wherein R is selected from the group consisting of hydrogen and alkyl groups having from about 1 to 2 carbon atoms;

the base blend exhibiting a MON of 105 or more.

72. The unleaded fuel composition of claim 71 further consisting of:

40 mg/kg lead replacement additive;

30 mg/kg antioxidant;

from about 1 to about 2 g/gallon detergent additive; and, optionally, one or more octane booster.

* * * * *